US007326152B2

(12) United States Patent
Gates

(10) Patent No.: US 7,326,152 B2
(45) **Date of Patent: *Feb. 5, 2008**

(54) INFANT WALKER

(76) Inventor: Donald K. Gates, 503 Manchester St., Fort Walton Beach, FL (US) 32547

( * ) Notice: Subject to any disclaimer, the term of this patent is extended or adjusted under 35 U.S.C. 154(b) by 0 days.

This patent is subject to a terminal disclaimer.

(21) Appl. No.: 11/481,239

(22) Filed: Jul. 5, 2006

(65) Prior Publication Data

US 2007/0004566 A1 Jan. 4, 2007

Related U.S. Application Data

(63) Continuation of application No. 10/224,725, filed on Aug. 20, 2002, now Pat. No. 7,097,599.

(51) Int. Cl.
*A63B 22/00* (2006.01)
*A61H 3/00* (2006.01)

(52) U.S. Cl. ..... 482/66; 135/67

(58) Field of Classification Search ..... 482/66–69; 280/87.051, 87.021; 297/21, 344.1; 472/1, 472/14–26; 135/67
See application file for complete search history.

(56) References Cited

U.S. PATENT DOCUMENTS 671,058 A * 4/1901 Resetar ..... 472/15
903,731 A * 11/1908 Kull ..... 472/15
2,638,345 A * 5/1953 Norvell ..... 472/21
3,730,587 A 5/1973 Bloxham et al.
3,893,666 A * 7/1975 Parsons ..... 472/21
4,181,281 A * 1/1980 Kosak ..... 248/416
4,807,841 A * 2/1989 Edstrom ..... 248/580
5,158,313 A * 10/1992 Becker ..... 280/87.021
5,211,607 A * 5/1993 Fermaglish et al. ..... 472/15
5,246,400 A * 9/1993 Klucik ..... 472/21
5,302,163 A 4/1994 Fermaglich et al.
5,330,390 A * 7/1994 Liebert et al. ..... 472/23
5,409,246 A 4/1995 Ali
5,409,437 A 4/1995 Lauro et al.
5,433,682 A 7/1995 Fermaglich et al.
5,688,211 A 11/1997 Myers
6,012,731 A 1/2000 Liu
6,048,290 A 4/2000 Chen et al.
6,386,563 B1 5/2002 Chen et al.
2005/0176342 A1 8/2005 Jackson et al.

OTHER PUBLICATIONS

KIDSII, Inc., "*BrightStarts Around We Go—Intro and Activity Station Instruction Guide*", www.brightstarts.com/, (2006) pp. (4) 1-26, Alpharetta, U.S.

* cited by examiner

*Primary Examiner*—Fenn C. Mathew
(74) *Attorney, Agent, or Firm*—Myers & Kaplan, LLC; Ash D. Patel; George P. Bonanto

(57) ABSTRACT

An infant walker that provides a safe and confined mechanism in which a child may effectively development the requisite stability and/or balance for proper walking skills and associated motor coordination, and wherein the infant walker is aesthetically pleasing to promote eager utilization of the walker by a child.

5 Claims, 14 Drawing Sheets

INFANT WALKER

This application is a Continuation Application of and claims priority to U.S. Non-Provisional patent application, Ser. No. 10/224,725, filed Aug. 20, 2002, and entitled, "Infant Walker", now U.S. Pat. No. 7,097,599.

TECHNICAL FIELD

The present invention relates generally to infant motor skill development apparatuses, and more specifically to an infant walker. The present invention is particularly suitable for, although not strictly limited to, assisting and supporting an infant/child in his/her developmental walking stages.

BACKGROUND OF THE INVENTION

Effective and timely development of infant motor skills is a crucial element in overall child development. As such, a variety of infant motor skill developmental apparatuses are readily available to assist children in the growth and development of such basic motor skills. In particular, infant walkers have long been utilized to promote stability and balance in assisting an infant child develop basic walking skills. In general, however, most such walkers possess inherent disadvantages that render their use problematic.

For instance, mobile walkers are disadvantageous, as they fail to confine a child to a safe and visible area, enabling the child/user to roam freely about the home and potentially expose him/herself to dangerous and/or unsafe conditions such as an open staircase leading to a lower level of the home, or a cabinet full of poisonous household cleaners and/or disinfecting solutions. Additionally, walker wheels possessing locking mechanisms are, in general, unsuccessful in preventing a child from freely roaming about the home, as the child usually possesses enough leg strength to counteract any tension/resistance delivered by the locked wheels. Furthermore, mobile walkers generally have a tendency to tip over if the child/user abruptly shifts his/her weight to one side of the walker or the other during movement of the walker, thus resulting in injury to the child's face, head, neck, spine and/or arms. Moreover, siblings within the vicinity of a moving walker are also subject to possible injury if struck thereby.

In addition to potential injury that a child/user may suffer, walls, baseboards and surrounding furniture are also subject to damage upon collision with the sides of a fast moving walker. Furthermore, hardwood floors and/or other hard-surface floorings tend to easily scuff, scratch, mark and/or dent as a result of the walker's hard plastic wheels frictionally rolling thereagainst, thus aging the floor far faster than anticipated.

Conventional infant walkers are further disadvantaged as they lack the optimal aesthetic appearance required to entice a child to utilize the walker. As such, a parent may often physically struggle with a resisting child when attempting to place the child within a walker, as the child is typically reluctant and/or unwilling to be placed within a seemingly uninviting confinement, thus hindering the parent from temporarily relieving him/herself of childcare duties.

Additionally, conventional infant walkers are equipped with wheels to assist in propelling the child/user across a surface. Such wheeled walkers, however, are disadvantageous, as they tend to overly assist a child in moving him/herself, preventing the child from fully utilizing his/her own leg muscles and thus, potentially protracting otherwise normal development of those leg muscles for independent, apparatus-free walking.

Therefore, it is readily apparent that there is a need for an infant walker that provides a safe, confined, stable and aesthetically pleasing mechanism for assisting and training a child in the effective development of his/her walking skills and associated motor coordination.

BRIEF SUMMARY OF THE INVENTION

Briefly described, in a preferred embodiment, the present invention overcomes the above-mentioned disadvantages, and meets the recognized need for such a device by providing an infant walker that provides a safe and confined mechanism in which a child may effectively develop the requisite stability and/or balance for proper walking skills and associated motor coordination, and wherein the infant walker is aesthetically pleasing to promote eager utilization of the walker by a child.

According to its major aspects and broadly stated, the present invention in its preferred form is an infant walker having a large base, a shaft centrally located on the base, an arm pivotally connected to the shaft and a seating assembly preferably in communication with the arm.

More specifically, the present invention is an infant walker having a large, flat, wide base that preferably functions as the walking platform, wherein the base preferably possesses a shaft centrally positioned thereon. A pivot arm, preferably perpendicularly and pivotally connected to the centrally positioned shaft, preferably possesses a seating assembly in communication therewith, wherein the pivot arm and communicating shaft preferably form a central axis in which a child placed within the seating assembly is able to walk in a complete circle relative to the central axis formed thereby. The infant walker further preferably possesses spacers that enable the height of the pivot arm and communicating seating assembly to be raised, wherein the seating assembly also possesses a swivel seat incorporated therein.

A feature and advantage of the present invention is its ability to effectively contribute to the growth and development of basic infant child walking skills and associated motor coordination, including the requisite stability and/or balance for proper walking.

A feature and advantage of the present invention is its ability to safely confine a child to a specified area and/or walking distance/parameters, thus permitting a parent to maintain his/her child within viewing distance/sight.

A feature and advantage of the present invention is its ability to prevent a child/user from roaming freely about the home and potentially exposing him/herself to dangerous and/or unsafe conditions such as an open staircase leading to a lower level of the home and/or a cabinet full of poisonous household cleaners and disinfecting solutions.

A feature and advantage of the present invention is its ability to entice a child to utilize the walker via the outwardly aesthetically inviting appearance of the walker, thus reducing the likelihood of a child physically struggling and/or resisting being placed within the walker by a parent.

A feature and advantage of the present invention is its stationary nature, thus preventing damage to walls, baseboards and surrounding furniture typically resulting from the collision of a walker therewith.

A feature and advantage of the present invention is its stationary nature, thus preventing hardwood floors and/or other hard-surface floorings from easily scuffing, scratching, marking and/or denting, wherein such damage typically results from a conventional walker's hard plastic wheels frictionally rolling thereagainst.

A feature and advantage of the present invention is its large, wide base that prevents the walker from being tipped over if the child/user abruptly shifts his/her weight to one side of the walker or the other during rotational movement of the walker.

A feature and advantage of the present invention is its ability to evenly distribute a child/user's weight during utilization of the walker by the-child/user.

A feature and advantage of the present invention is its ability to permit a child/user to rotate within the seating assembly via an incorporated swivel seat.

A feature and advantage of the present invention is its ability to permit a child/user to rotate in either a forward or reverse direction.

A feature and advantage of the present invention is its ability to accommodate food, beverages and/or child toys via a tray incorporated into the seating assembly.

A feature and advantage of the present invention is its ability to be adjusted in height to accommodate the height of any child/user.

A feature and advantage of the present invention is its portability.

A feature and advantage of the present invention is its ease of assembly.

A feature and advantage of the present invention is its ease of storage.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structures and refer to like elements throughout, and in which.

DETAILED DESCRIPTION OF THE PREFERRED AND ALTERNATIVE EMBODIMENTS

Figure 1:
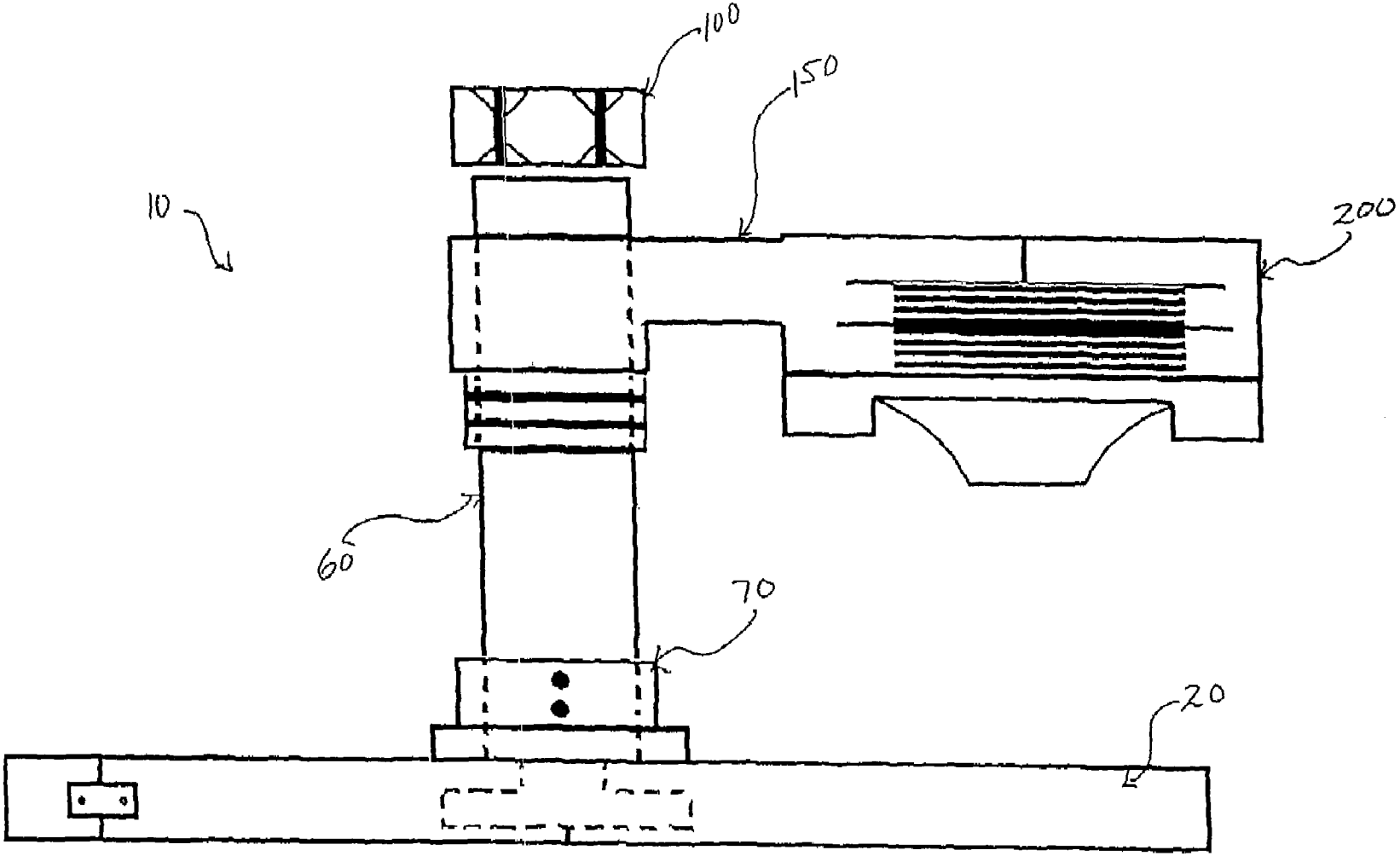
FIG. 1 illustrates an infant walker according to a preferred embodiment of the present invention.
Figure 2:
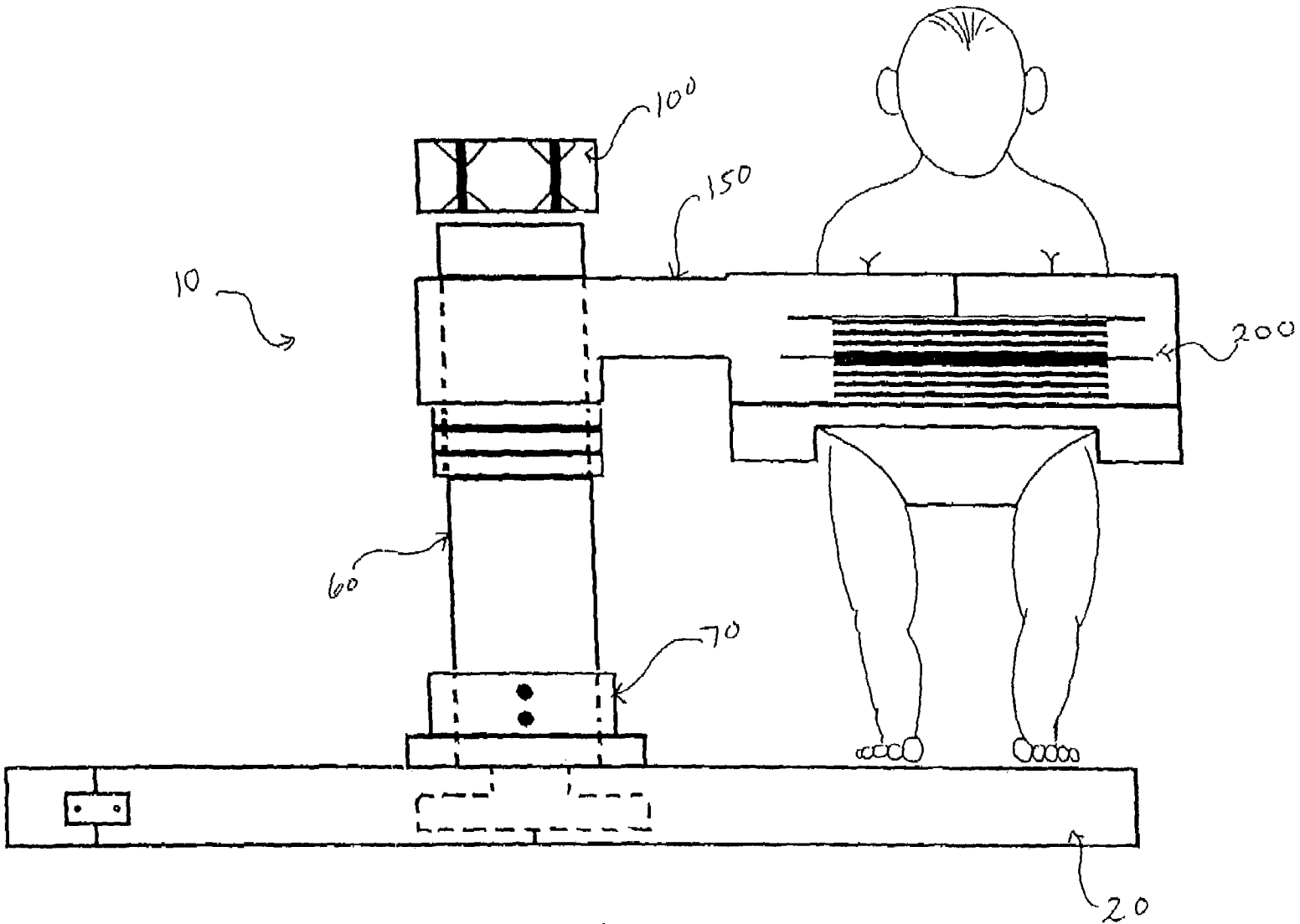
FIG. 2 illustrates an infant walker according to a preferred embodiment of the present invention showing a child/user situated therein.
Figure 3:
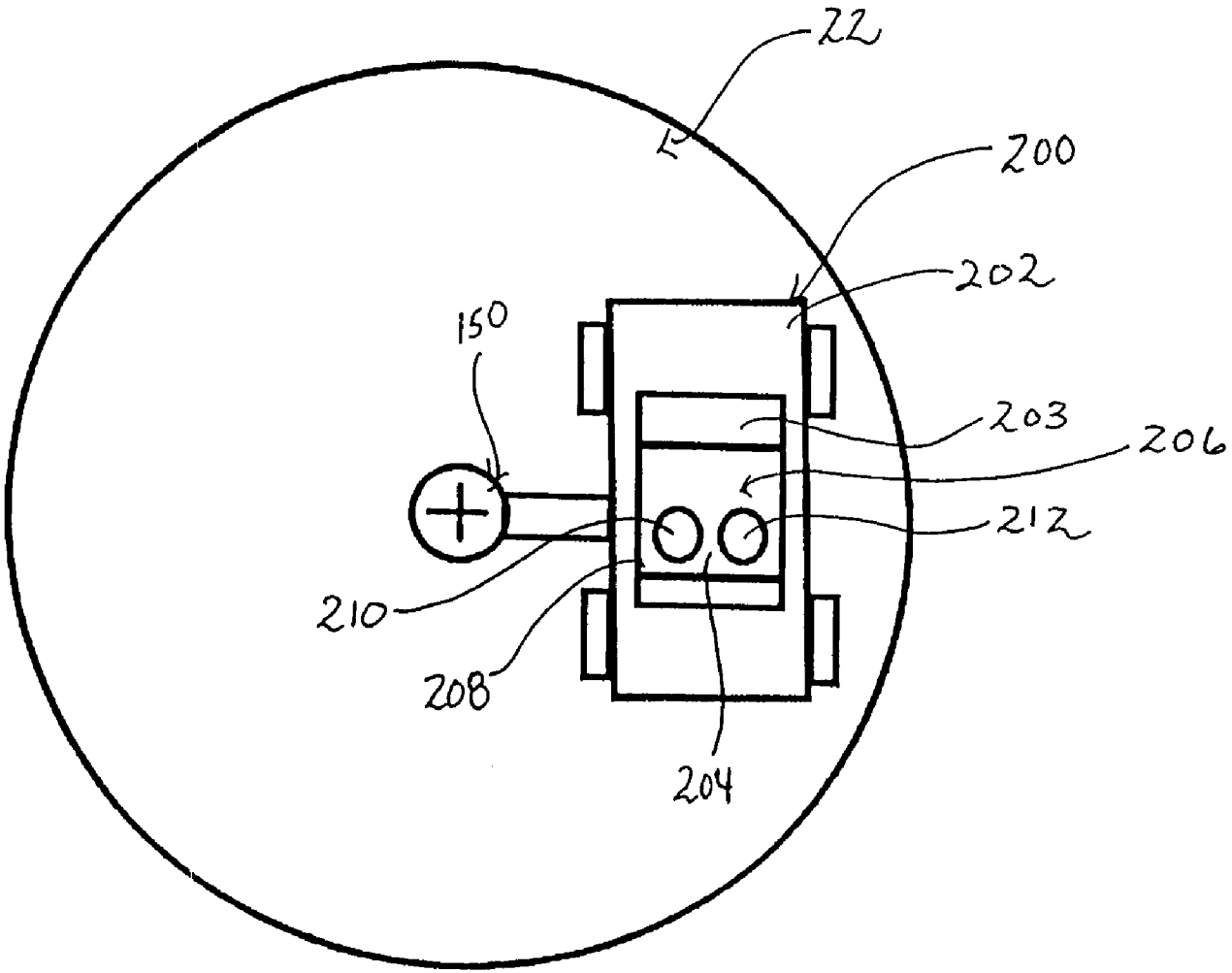
FIG. 3 is a top view of an infant walker according to a preferred embodiment of the present invention.

In describing the preferred and alternate embodiments of the present invention, as illustrated in FIGS. 1-13, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-7, the present invention in its preferred embodiment is an infant walker 10 having base assembly 20, shaft assembly 60, pivot arm 150 and seat assembly 200, wherein shaft assembly 60 preferably extends perpendicularly from base assembly 20, and wherein pivot arm 150 and seat assembly 200 are preferably in rotary communication with shaft assembly 60, as more fully described below.

Referring now more specifically to FIGS. 4-7, base assembly 20 preferably possesses a substantially circular-shaped disk-like platform 22, wherein platform 22 preferably possesses first platform member 24 and second platform member 38, and wherein first platform member 24 and second platform member 38 are preferably substantially semi-circular-shaped and preferably interlockingly engage to form platform 22. Specifically, first platform member 24 preferably possesses lower portion 26, middle portion 28 and upper portion 30, wherein middle portion 28 is preferably positioned between lower portion 26 and upper portion 30, and wherein lower portion 26, middle portion 28 and upper portion 30 are preferably substantially semi-circular-shaped. Preferably, middle portion 28 possesses cutaway 28*a* formed along edge 28*b* of middle portion 28, wherein cutaway 28*a* is preferably generally semi-circular-shaped to enable accommodation of shaft assembly 60 therein, as more fully described below. Similarly, upper portion 30 preferably possesses cutaway 30*a* formed along edge 30*b* of upper portion 30, wherein cutaway 30*a* is preferably generally semi-circular-shaped to enable accommodation of shaft assembly 40 therein, and wherein cutaway 30*a* of upper portion 30 preferably possesses a smaller diameter than cutaway 28*a* of middle portion 28 for assistance in anchoring shaft assembly 60 therein as more fully described below. As a result of respective cutaways 28*a* and 30*a*, edge 28*b* of middle portion 28 preferably possesses ends 28*c* and 28*d*, and edge 30*b* of upper portion 30 preferably possesses ends 30*c* and 30*d*, wherein ends 30*c* and 30*d* of edge 30*b* of upper portion 30 are preferably flush with edge 26*b* of lower portion 26. End 28*c* of edge 28*b* of middle portion 28 is preferably recessed within upper portion 30 and lower portion 26, thus forming vacancy 32. End 28*d* of edge 28*b* of middle portion 28 preferably slightly outwardly protrudes beyond upper portion 30 and lower portion 26.

Formed preferably on upper portion 30, proximal to end 30*c* of upper portion 30 and extending radially from cutaway 30*a* is first set of throughholes 34, wherein second set of throughholes 36 is also preferably formed on upper portion 30, proximal to end 30*d* of upper portion 30 and extending radially from cutaway 30*a*. Throughholes 34 and 36 preferably function to secure shaft assembly 60 to platform 22 of base assembly 20 as more fully described below. Although lower portion 26, middle portion 28 and upper portion 30 are preferably integrally formed together, it is contemplated in an alternate embodiment that lower portion 26, middle portion 28 and upper portion 30 could be formed separately and then subsequently secured to one another via any suitable securing means as known within the art. Lower portion 26, middle portion 28 and upper portion 30 are preferably formed from a durable plastic; although other suitable material could be used. Furthermore, although the overall preferred shape of platform 22 is circular, it is contemplated in an alternate embodiment that platform 22 could possess a different shape, such as, for exemplary purposes only, square, rectangular, diamond, oval and/or any other desired shape.

Similarly, second platform member 38 of platform 22 preferably possesses lower portion 40, middle portion 42 and upper portion 44, wherein middle portion 42 is preferably positioned between lower portion 40 and upper portion 44, and wherein lower portion 40, middle portion 42 and upper portion 44 are preferably substantially semi-circular-shaped. Preferably, middle portion 42 possesses cutaway 42*a* formed along edge 42*b* of middle portion 42, wherein cutaway 42*a* is preferably generally semi-circular-shaped to enable accommodation of shaft assembly 60 therein, as more fully described below. Similarly, upper portion 44 preferably possesses cutaway 44*a* formed along edge 44*b* of upper portion 44, wherein cutaway 44*a* is preferably generally semi-circular-shaped to enable accommodation of shaft assembly 40 therein, and wherein cutaway 44*a* of upper portion 44 preferably possesses a smaller diameter than cutaway 42*a* of middle portion 42 for assistance in anchoring shaft assembly 60 therein as more fully described below. As a result of respective cutaways 42*a* and 44*a*, edge 42*b* of middle portion 42 preferably possesses ends 42*c* and 42*d*, and edge 44*b* of upper portion 44 preferably possesses ends 44*c* and 44*d*, wherein ends 44*c* and 44*d* of edge 44*b* of upper portion 44 are preferably flush with edge 40*b* of lower portion 40. End 42*c* of edge 42*b* of middle portion 42 preferably slightly outwardly protrudes from upper portion 44 and lower portion 40. End 42*d* of edge 42*b* of middle portion 42 is preferably recessed within upper portion 44 and lower portion 40, thus forming vacancy 46.

Formed preferably on upper portion 44, proximal to end 44*c* of upper portion 44 and extending radially from cutaway 44*a* is first set of throughholes 48, wherein second set of throughholes 50 is also preferably formed on upper portion 44, proximal to end 44*d* of upper portion 44 and extending radially from cutaway 44*a*. Throughholes 48 and 50 preferably function to secure shaft assembly 60 to platform 22 of base assembly 20 as more fully described below. Although lower portion 40, middle portion 42 and upper portion 44 are preferably integrally formed together, it is contemplated in an alternate embodiment that lower portion 40, middle portion 42 and upper portion 44 could be formed separately and then subsequently secured to one another via any suitable securing means as known within the art. Lower portion 40, middle portion 42 and upper portion 44 are preferably formed from a durable plastic; although other suitable material could be used. Furthermore, although the overall preferred shape of platform 22 is circular, it is contemplated in an alternate embodiment that platform 22 could possess a different shape, such as, for exemplary purposes only, square, rectangular, diamond, oval and/or any other desired shape.

Figure 7:
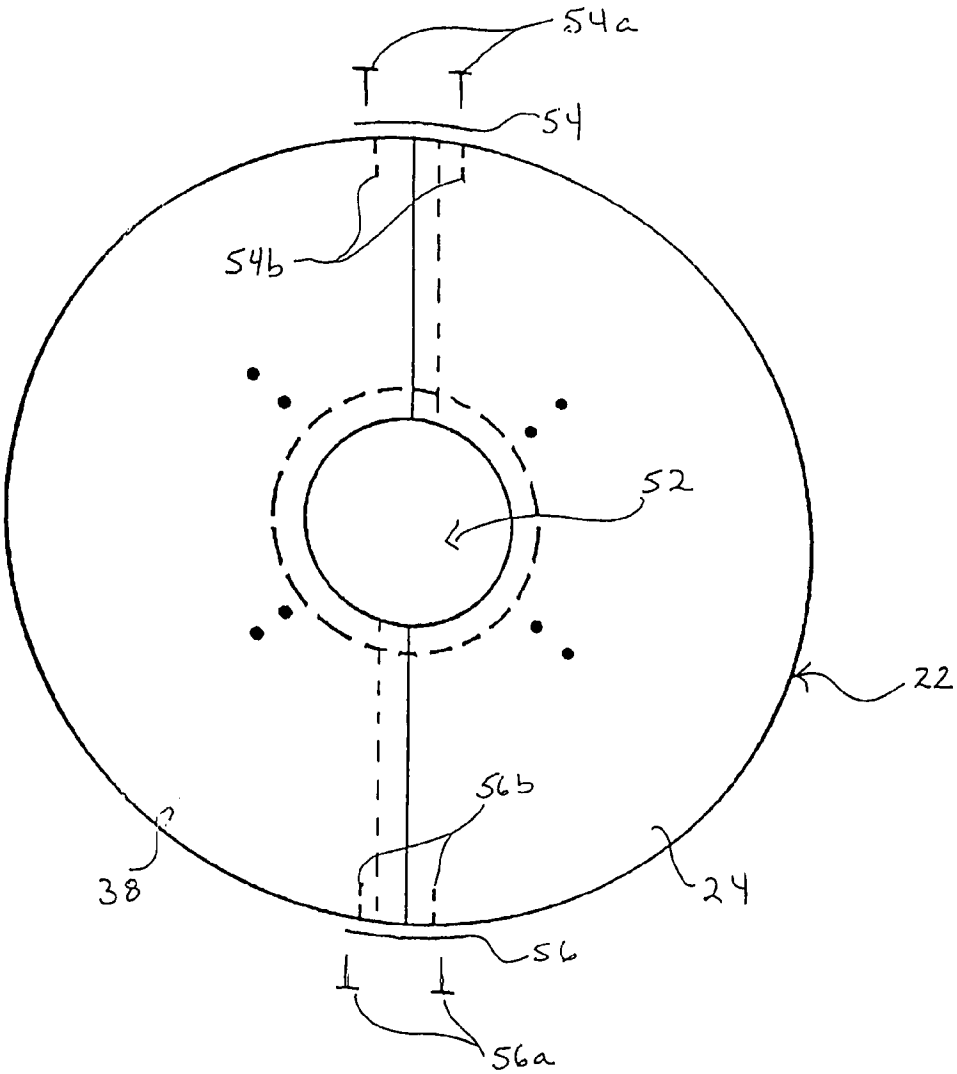
FIG. 7 is a top view of the base of an infant walker according to a preferred embodiment of the present invention.

Upon interlockingly engaging first platform member 24 with second platform member 38, edge 26*b* of lower portion 26 of first platform member 24 preferably contacts and abuts edge 40*b* of lower portion 40 of second platform member 38; vacancy 32 of first platform member 24 preferably receives end 42*c* of edge 42*b* of middle portion 42 of second platform member 38, thus permitting edge 42*b* thereof to contact edge 28*b* of middle portion 28 of first platform member 24; vacancy 46 of second platform member 38 preferably receives end 28*d* of edge 28*b* of middle portion 28 of first platform member 24, thus permitting edge 28*b* thereof to contact edge 42*b* of middle portion 42 of second platform member 38; ends 30*c* and 30*d* of upper portion 30 of first platform member 24 preferably contact and abut ends 44*c* and 44*d*, respectively, of upper portion 44 of second platform member 38; and cutaways 28*a* and 30*a* of middle portion 28 and upper portion 30, respectively, of first platform member 24 preferably align with cutaways 42*a* and 44*a* of middle portion 42 and upper portion 44, respectively, of second platform member 24, thus forming cavity 52 for receipt therein of shaft assembly 60, as more fully described below. To provide overall stability for platform 22, brackets 54 and 56 are preferably secured to joined first platform member 24 and second platform member 38 via insertion of screws 54*a* and 56*a*, respectively through throughholes 54*b* and 56*b*, respectively, each opposingly formed on first platform member 24 and second platform member 38 as best illustrated in FIG. 7.

Referring back to FIG. 4, prior to interlockingly engaging first platform member 24 with second platform member 38 of platform 22 of base assembly 20, shaft assembly 60 is preferably first positioned and secured therein. Specifically, shaft 62 of shaft assembly 60 is preferably generally cylindrically-shaped, having first end 62*a* and second end 62*b*, wherein second end 62*b* preferably possesses anchor member 64 in communication therewith. Anchor member 64 preferably possesses a cylinder portion 64*a* having a smaller diameter than shaft 62, and a preferably flat disk portion 64*b* having a preferably larger diameter than both shaft 62 and cylinder portion 64*a*. Prior to securing first platform member 24 to second platform member 38, disk portion 64*b* of anchor member 64 is preferably received within the confines of cutaways 28*a* and 42*a* of middle portions 28 and 42, respectively, of first platform member 24 and second platform member 38, respectively, created upon the joining of first platform member 24 with second platform member 38; and cylinder portion 64*a* of anchor member 64 is preferably received within the confines of cutaways 30*a* and 44*a* of upper portions 30 and 44, respectively, of first platform member 24 and second platform member 38, respectively, created upon the joining of first platform member 24 with second platform member 38, wherein bottom surface 64*c* of disk portion 64*b* preferably contacts and abuts top surfaces 26*a* and 40*a* of lower portions 26 and 40, respectively, of first platform member 24 with second platform member 38, respectively, thus further buttressing shaft 62 therein.

Preferably formed proximal to end 62*b* of shaft 62 are throughholes 66 for securing sleeve 70 thereto, wherein sleeve 70 preferably possesses a cylinder portion 70*a* and a preferably flat disk portion 70*b*, wherein cylinder portion 70*a* and disk portion 70*b* preferably possess a diameter dimensioned so as to allow sleeve 70 to slidably engage shaft 62 and be secured to platform 22. Specifically, disk portion 70*b* preferably possesses throughholes 72 and 74 that preferably align with throughholes sets 34 and 36, respectively, of first platform member 24, wherein disk portion 70*b* further preferably possesses throughholes 76 and 78 that preferably align with throughholes sets 48 and 50, respectively, of second platform member 38, and wherein screws 80 are preferably inserted through throughholes 72, 74, 76 and 78 of sleeve 70 and threaded throughhole sets 34, 36, 48 and 50 of platform 22 for securement of shaft 62 thereto. Cylinder portion 70*a* of sleeve 70 preferably possesses throughholes 82 that preferably align with throughholes 66 of shaft 62, wherein screws 84 are preferably inserted therethrough for added securement of sleeve 70 to shaft 62 and for overall stability of shaft 62 when attached to platform 22. Shaft 62 and sleeve 70, and shaft assembly 60 in general, are preferably formed from a durable plastic; although other suitable materials may be used.

Figure 4:
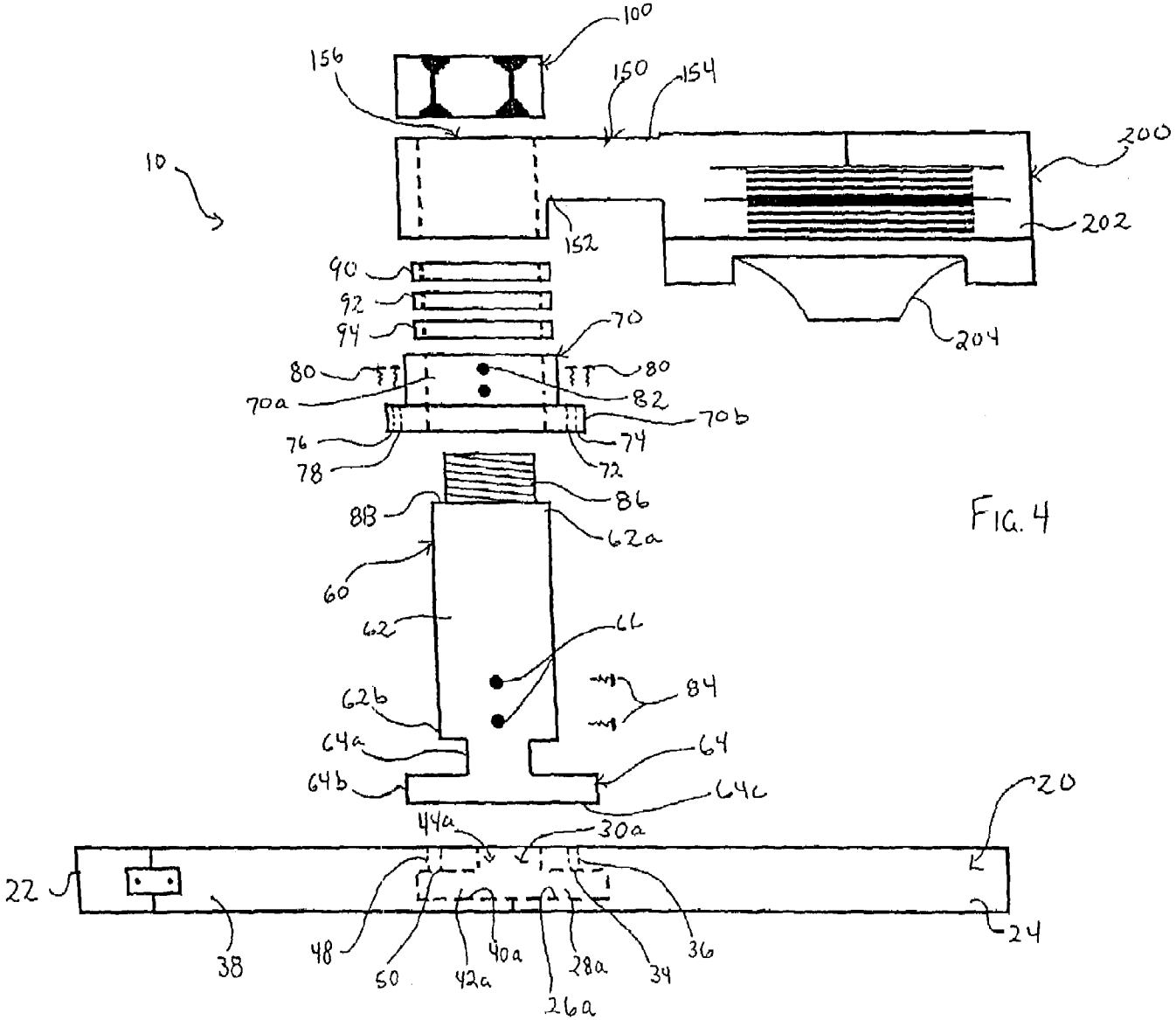
FIG. 4 is an exploded view of an infant walker according to a preferred embodiment of the present invention.
Figure 5:
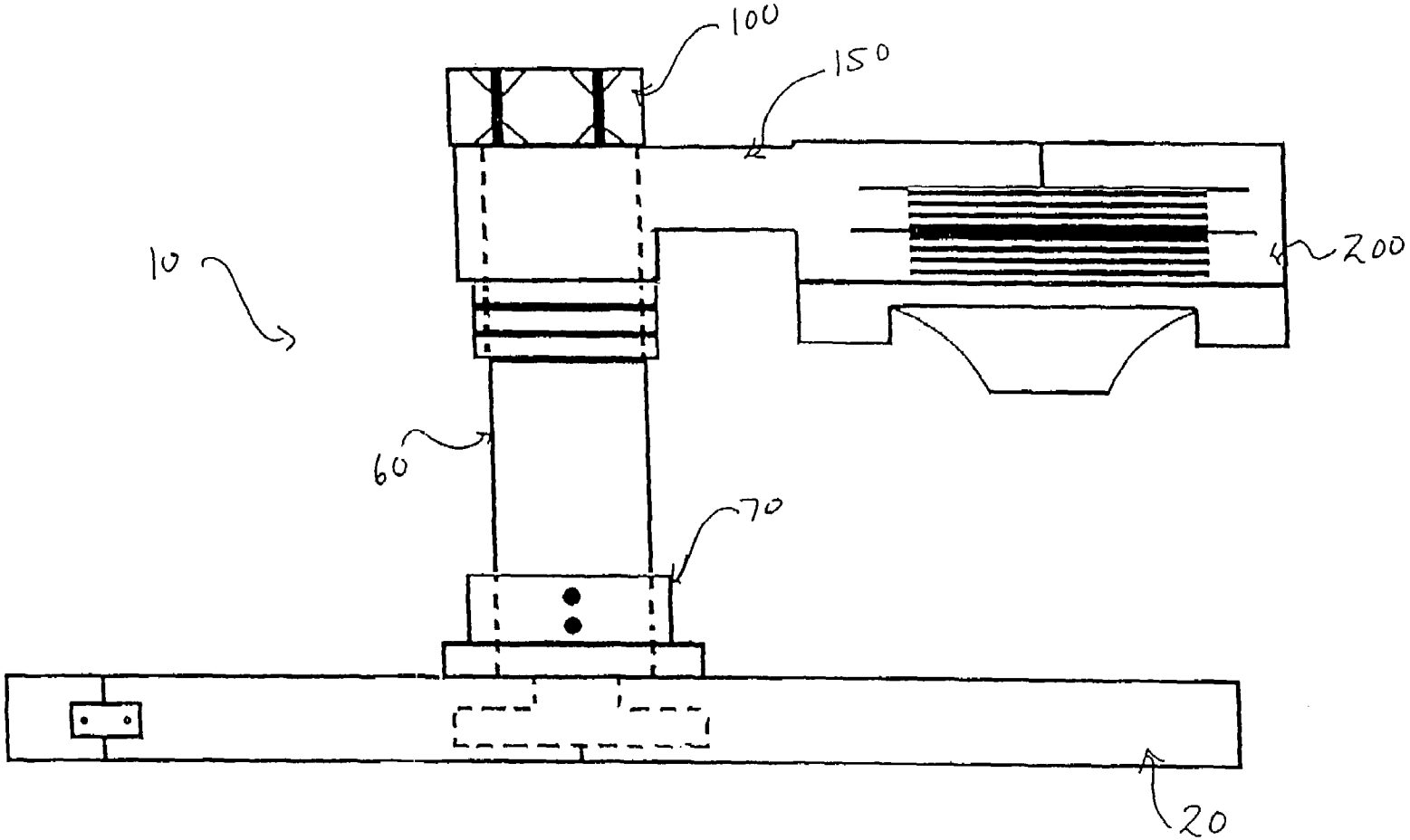
FIG. 5 is an assembled view of an infant walker according to a preferred embodiment of the present invention.
Figure 6:
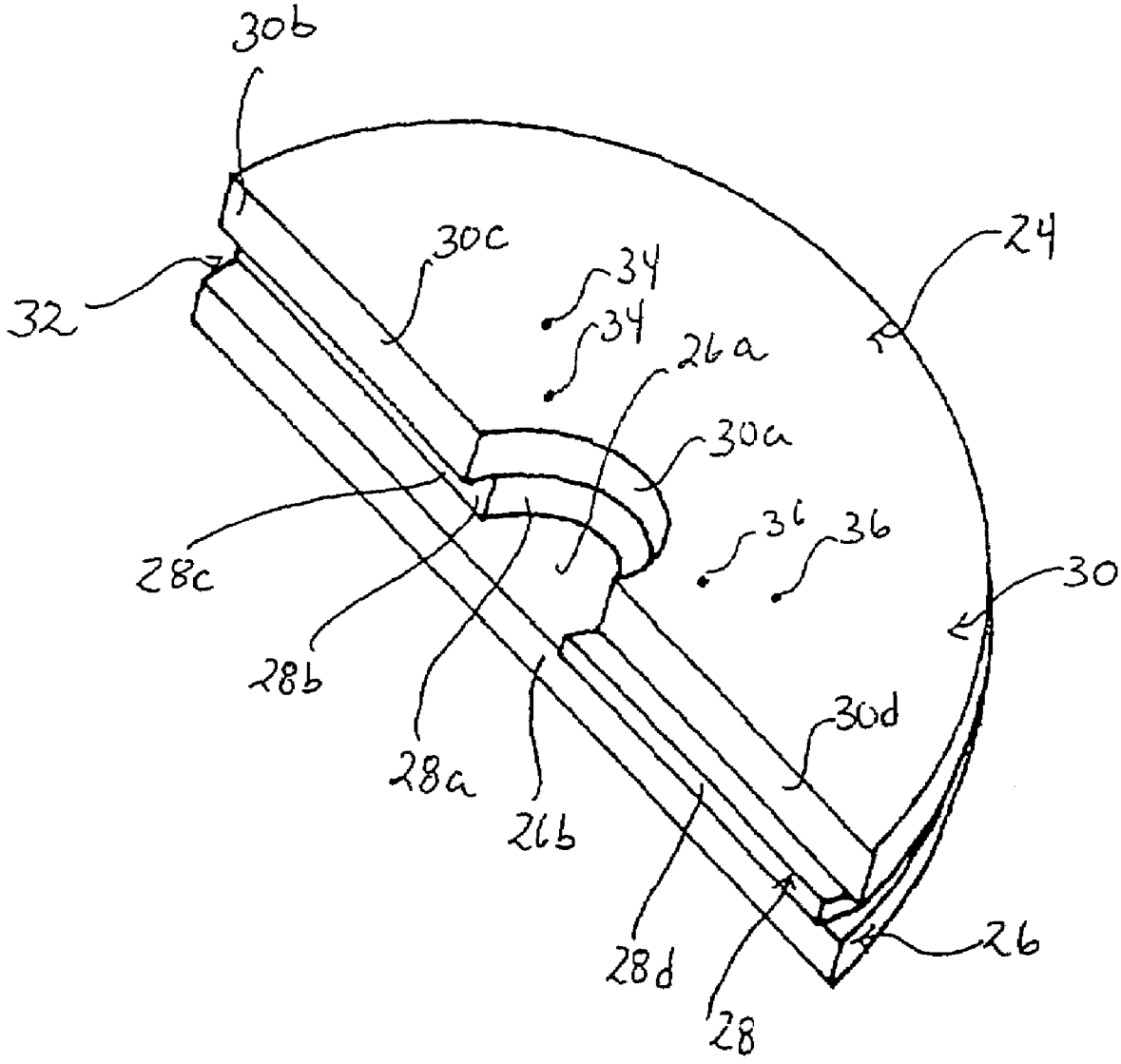
FIG. 6 is a perspective view of a base portion of an infant walker according to a preferred embodiment of the present invention.
Figure 6A:
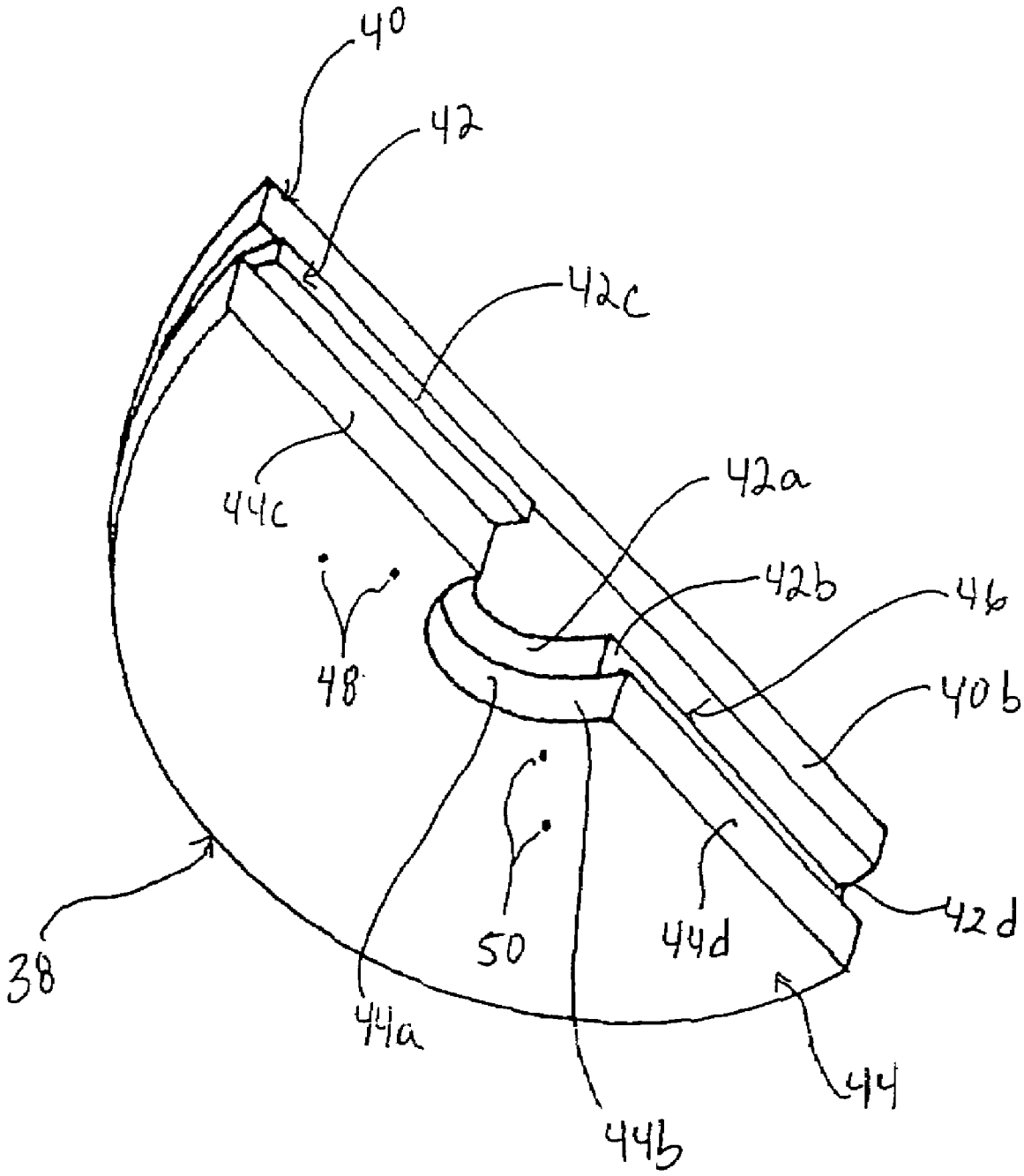
FIG. 6A is a perspective view of a base portion of an infant walker according to a preferred embodiment of the present invention.

Preferably, end 62*a* of shaft 62 of shaft assembly 60 possesses a threaded portion 86 in communication therewith, wherein threaded portion 86 preferably receives nut 100 for securing and/or maintaining pivot arm 150 and seat assembly 200 in rotary communication with shaft 62, as more fully described below. Preferably, threaded portion 86 possesses a smaller diameter than shaft 62, thus forming ledge 88, wherein ledge 88 preferably serves as a buttress and/or stop for support thereon of pivot arm 150, as more fully described below, and/or for support thereon of spacers 90, 92 and 94. Spacers 90, 92 and 94 are preferably ring-like and preferably possess a diameter dimensioned to receive threaded portion 86 of shaft 62, whereupon spacers 90, 92 and 94 are subsequently brought to rest on ledge 88. Spacers 90, 92 and 94 are preferably utilized individually and/or in combination to manipulate the height of pivot arm 150 and communicating seat assembly 200 when pivot arm 150 is positioned thereon, as best illustrated in FIGS. 4-5. Spacers 90, 92 and 94 and nut 100 are preferably formed from a durable plastic; although other suitable materials may be utilized. It is contemplated in an alternate embodiment that any number of spacers may be utilized to adjust the overall height of pivot arm 150 and communicating seat assembly 200.

Pivot arm 150 is preferably elongated rectangular-shaped, preferably possessing ends 152 and 154, wherein end 152 preferably possesses circular-shaped aperture 156 formed therethrough and dimensioned to slidably engage threaded portion 86 of shaft 62, and wherein end 154 is in communication with seat assembly 200, as best illustrated in FIGS. 4-5. Aperture 156 of pivot arm 150 preferably enables pivot arm 150 to completely rotate and/or pivot around shaft 62. Pivot arm 150 is preferably formed from a durable plastic; although other suitable materials may be utilized.

End 154 of pivot arm 150 is preferably in communication with seating assembly 200, wherein seating assembly 200 preferably possesses walker body 202 and seat 204. Walker body 202 is preferably shaped as an automobile so as to entice a child to utilize infant walker 10 as a result of the outwardly aesthetically inviting appearance of walker body 202, wherein the conventional location of an automobile dashboard is preferably replaced by tray 203 in walker body 202, and wherein tray 203 preferably functions to receive and support toys, food and/or beverages place thereon. Although the preferred shape and/or appearance of walker body 202 is that of an automobile, it is contemplated that walker body 202 could possess other shapes and/or appearances, such as, for exemplary purposes only, an airplane, boat, train, motorcycle, animal and/or a conventional walker shape/appearance. Walker body 202 further preferably possesses inner space 206, wherein inner space preferably accommodates seat 204.

Specifically, seat 204 is preferably formed from a soft malleable material, such as, for exemplary purposes, cotton and/or other suitable material as known within the art, wherein seat 204 is preferably attached to inner sides 208 of walker body 20 via any suitable attaching means as known within the art, such as, for exemplary purposes only, stitching, riveting and/or integrally formed therewith. Seat 204 further preferably possesses leg throughholes 210 and 212 formed therethrough for accommodation of a child/user's legs therethrough.

Referring now to FIGS. 8-11, the present invention in an alternate embodiment is an infant walker 300 having base assembly 320, shaft member 360, pivot arm 450 and seat assembly 500, wherein shaft member 360 extends perpendicularly from base assembly 320, and wherein pivot arm 450 and seat assembly 500 are in rotary communication with shaft assembly 360, as more fully described below.

Base assembly 320 possesses a substantially circular-shaped disk-like platform 322, wherein platform 322 possesses centrally positioned and integrally formed shaft member 360 extending perpendicularly therefrom, wherein shaft member 360 is generally cylindrically-shaped, having first end 362*a* and second end 362*b*, and wherein second end 362*b* is in integral communication with platform 322. End 362*a* of shaft member 360 possesses a threaded portion 386 in communication therewith, wherein threaded portion 386 receives nut 600 for securing and/or maintaining pivot arm 450 and seat assembly 500 in rotary communication with shaft member 360.

Figure 8:
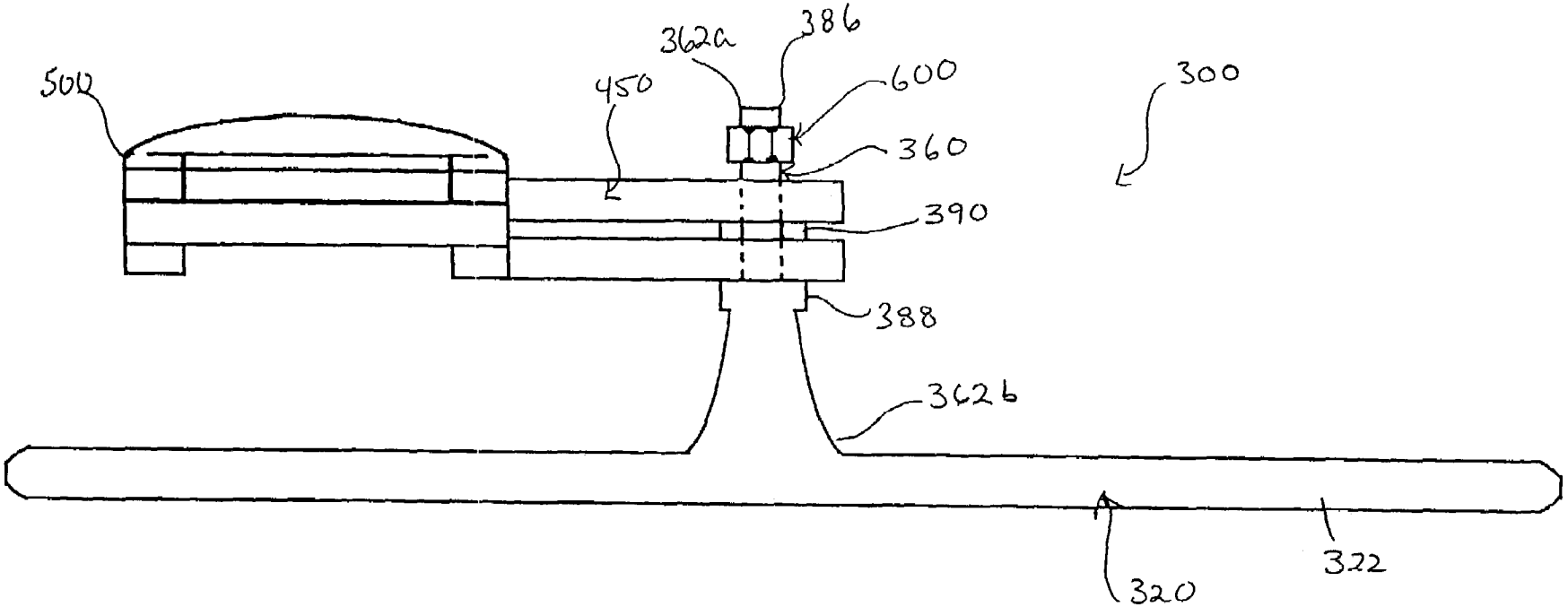
FIG. 8 illustrates an infant walker according to an alternate embodiment of the present invention.
Figure 9:
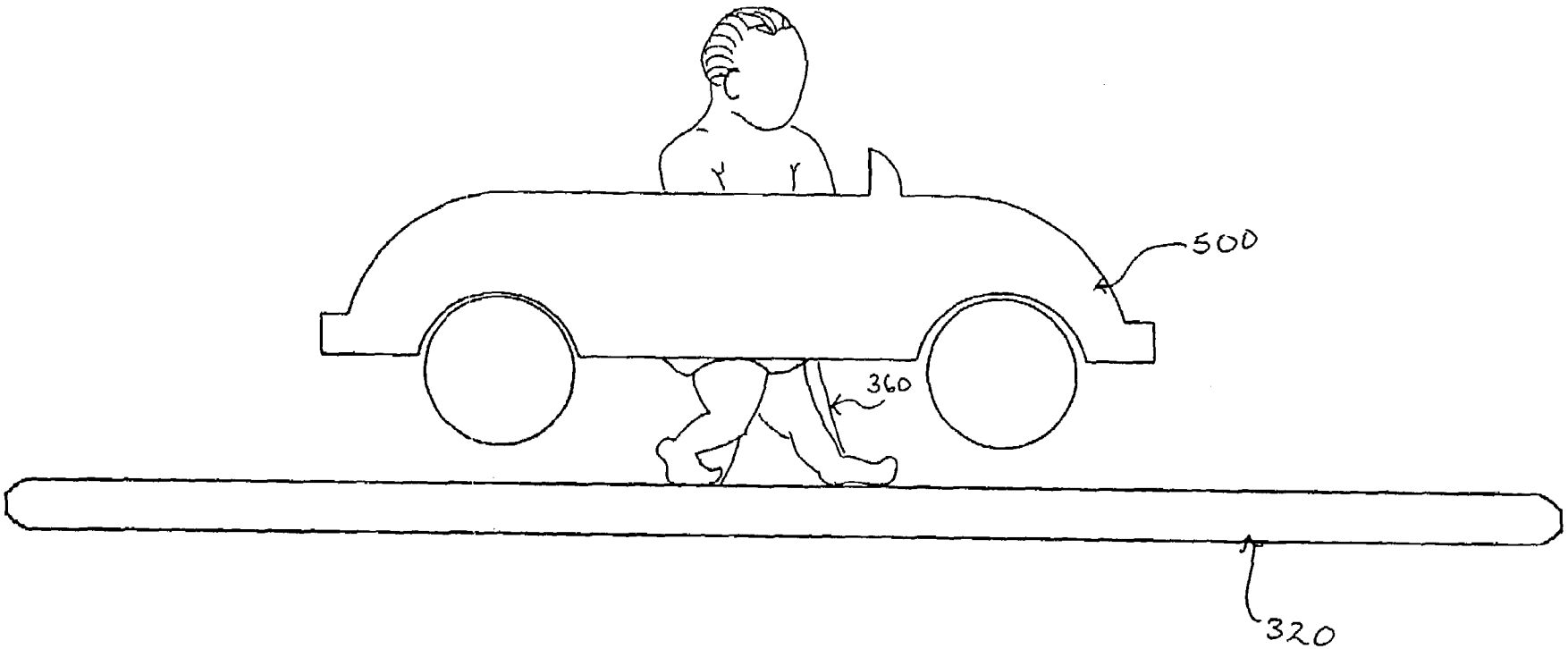
FIG. 9 illustrates an infant walker according to an alternate embodiment of the present invention showing a child/user situated therein.

Formed proximal end 362*b* of shaft member 360 is ledge 388, wherein ledge 388 serves as a buttress and/or stop for support thereon of pivot arm 450, as more fully described below, and/or for support thereon of spacer 390. Spacer 390 is ring-like and possesses a diameter dimensioned to receive shaft member 360, whereupon spacer 390 is subsequently brought to rest on ledge 388. Spacer 390 is utilized to manipulate the height of pivot arm 450 and communicating seat assembly 506 when pivot arm 450 is positioned thereon, as best illustrated in FIGS. 8-9. It is contemplated in another alternate embodiment that any number of spacers may be utilized to adjust the overall height of pivot arm 450 and communicating seat assembly 500.

Figure 10:
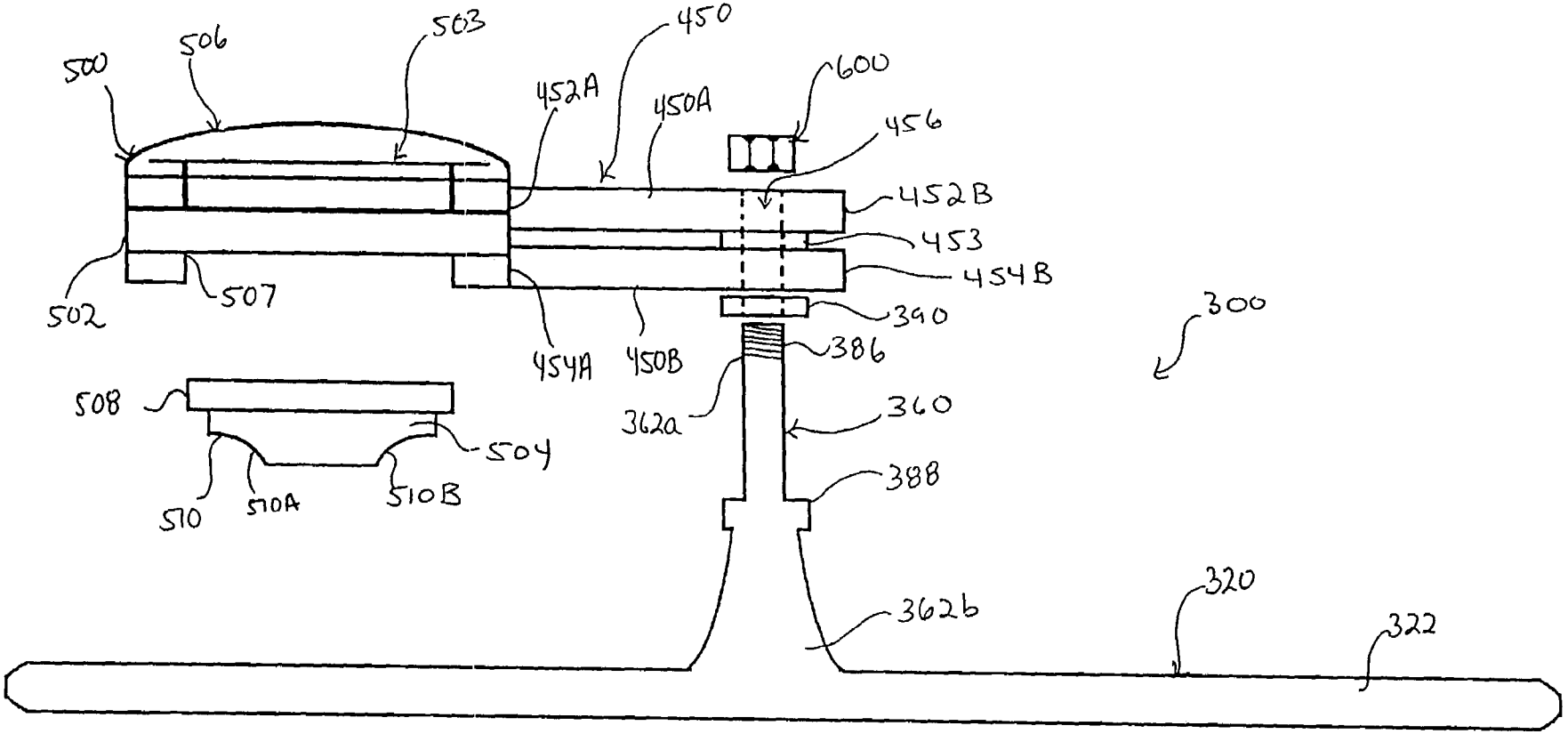
FIG. 10 is an exploded view of an infant walker according to an alternate embodiment of the present invention.

Referring now to FIG. 10, pivot arm 450 is elongated rectangular-shaped, possessing first pivot arm 450A and second pivot 450B, wherein first pivot arm 450A possesses ends 452A and 452B, and wherein second pivot 450B possesses ends 454A and 454B. First pivot arm 450A and second pivot 450B are separated via spacer 453, wherein ends 452B and 454B and spacer 453 possess shared circular-shaped aperture 456 formed therethrough and dimensioned to slidably engage threaded portion 386 and shaft member 360, and wherein ends 452A and 454A are in communication with seat assembly 500, as best illustrated in FIGS. 10. Aperture 456 of pivot arm 450 enables pivot arm 450 to completely rotate and/or pivot around shaft member 360.

Ends 452A and 454A of pivot arm 450 are in communication with seating assembly 500, wherein seating assembly 500 possesses walker body 502 and seat 504. Walker body 502 is shaped as an automobile so as to entice a child to utilize infant walker 300 as a result of the outwardly aesthetically inviting appearance of walker body 502, wherein the conventional location of an automobile dashboard is replaced by tray 503 in walker body 502, and wherein tray 503 functions to receive and support toys, food and/or beverages place thereon. Although the shape and/or appearance of walker body 502 is that of an automobile, it is contemplated that walker body 502 could possess other shapes and/or appearances, such as, for exemplary purposes only, an airplane, boat, train, motorcycle, animal and/or a conventional walker shape/appearance. Walker body 502 further possesses inner space 506, wherein inner space accommodates seat 504.

Figure 11:
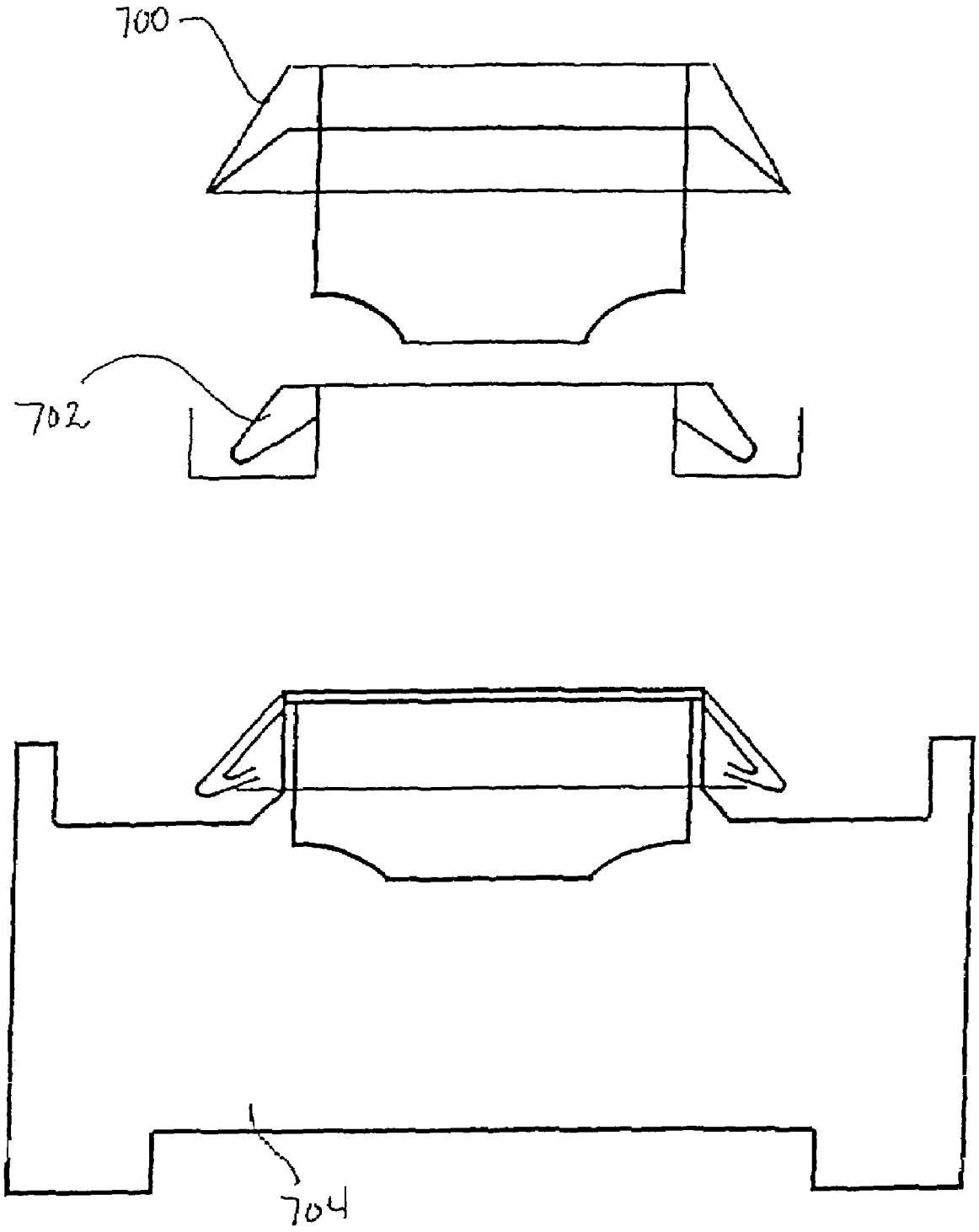
FIG. 11 is a side view of the swivel seat of an infant walker according to an alternate embodiment of the present invention.

Specifically, seat 504 possesses a ring-shaped rotary member 508 and seat section 510 formed from a soft malleable material, such as, for exemplary purposes, cotton and/or other suitable material as known within the art, wherein rotary member 508 permits the stationary swivel of a child within walker body 502, and wherein rotary member 508 is rotatably engaged to inner sides 507 of walker body 502 via any suitable means/mechanism as known within the art, such as, for exemplary purposes only, any suitable rotary mechanism and/or ball-bearing mechanism. Seat section 510 further possesses leg throughholes 510A and 510B formed therethrough for accommodation of a child/user's legs therethrough. As best illustrated in FIG. 11, a swivel seat 700 could rotatably engage a protrusion 702 formed in walker body 704 in a snap-fit manner, thereby allowing an infant to swivel therein.

Figure 12:
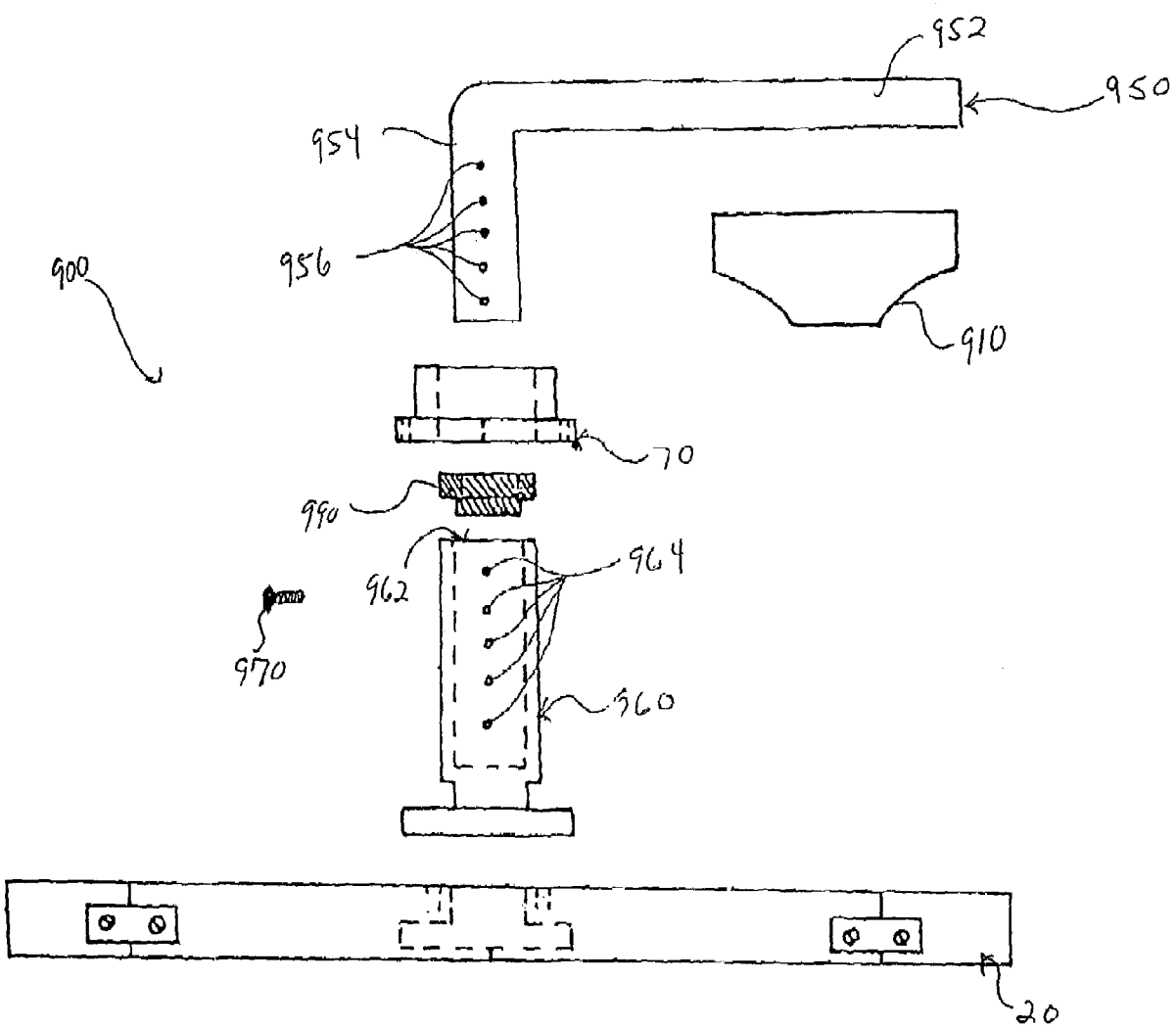
FIG. 12 is an exploded view of an infant walker according to an alternate embodiment of the present invention.
Figure 13:
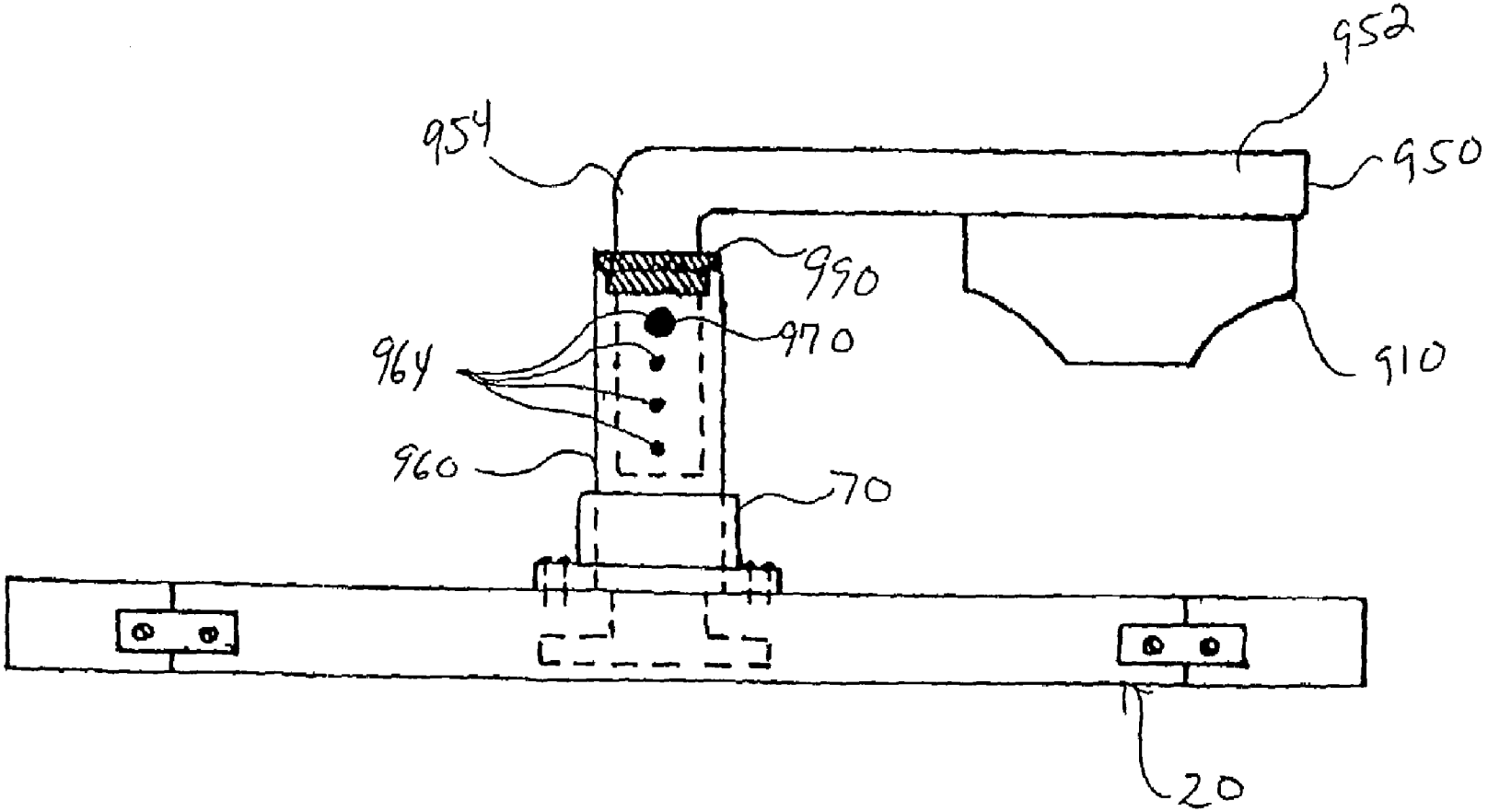
FIG. 13 is an assembled view of an infant walker according to an alternate embodiment of the present invention.

Referring now to FIGS. 12-13, the present invention in an alternate embodiment is an infant walker 900 having base assembly 20, shaft member 960, pivot arm 950 and seat 910, wherein shaft member 960 extends perpendicularly from base assembly 20, and wherein pivot arm 950 and seat 910 are in rotary communication with shaft assembly 960, as more fully described below.

Shaft member 960 is cylindrical-shaped and possesses channel 962 for recession therein of pivot arm 950, as more fully described below. Channel 962 is further dimensioned to receive ring-like spacer 990 therein for the manipulation of the height of pivot arm 950 and communicating seat 910 relative to base assembly 20. Formed on shaft member 960 is a plurality of aligned throughholes 964 that are aligned with throughholes 956 formed on pivot arm 950 for adjustment of the height of pivot arm 950 relative to base assembly 20, as more fully described below. Shaft member 960 is secured within base assembly 20 with further assistance from sleeve 70.

Pivot arm 950 of walker 900 is L-shaped, possessing first portion 952 and second portion 954, wherein first portion 952 is parallel to base assembly 20 and is in communication with seat 910, and wherein second portion 954 is perpendicular to base assembly 20 and dimensioned to recess and freely rotate within channel 962 of shaft member 960. Formed on second portion 954 of pivot arm 950 is a plurality of aligned throughholes 956 that align with plurality of throughholes 964 of shaft member 960 upon insertion of second portion 954 into channel 962 of shaft member 960. As such, utilization of bolt 970 permits the adjustment of the height of pivot arm 950 relative to base assembly 20 via the insertion of bolt 970 through one of plurality of throughholes 964 of shaft member 960 and then through one of plurality of throughholes 956 of pivot arm 950.

It is contemplated in an alternate embodiment that device 10 could possesses interchangeable seats of the non-swivel and swivel types.

It is contemplated in an alternate embodiment that base assembly 20 of device 10 could be separated into any number of joinable sections.

It is contemplated in an alternate embodiment that pivot arm 150 and/or seat 204 could possesses spring-mechanisms to permit a child/user to bounce within walker body 202.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. An infant walker, comprising:

a base;

a vertical shaft having a lower end connected to said base, and an upper end having a reduced cross-section;

means for supporting an infant,said supporting means comprising a seat and at least one arm having a first end pivotally connected to said upper end of said vertical shaft and an opposing second end in communication with said seat; and a plurality of spacers removably engaging said upper end of said vertical shaft for raising the height of said supporting means.

2. The infant walker of claim 1, wherein said base is at least one stationary platform.

3. The infant walker of claim 1, wherein said seat comprises a seat selected from a group consisting of at least one stationary seat and at least one swivel seat.

4. The infant walker of claim 3, wherein said support means comprises a body, wherein said body interchangeably receives said at least one stationary seat and said at least one swivel seat.

5. The infant walker of claim 1, wherein said support means is carried by said base to enable the infant to travel over said base when said infant walker is in use.

* * * * *